US005940889A

United States Patent [19]

Shirai

[11] Patent Number: 5,940,889

[45] Date of Patent: Aug. 24, 1999

[54] PROTECTIVE CAP

[75] Inventor: Syoji Shirai, Kawasaki, Japan

[73] Assignee: Sea Raise Corporation Co., Ltd., Kawasaki, Japan

[21] Appl. No.: 08/981,712

[22] PCT Filed: Aug. 7, 1996

[86] PCT No.: PCT/JP96/02221

§ 371 Date: Dec. 23, 1997

§ 102(e) Date: Dec. 23, 1997

[87] PCT Pub. No.: WO97/06706

PCT Pub. Date: Feb. 27, 1997

[30] Foreign Application Priority Data

| | | | |
|---|---|---|---|
| Aug. 11, 1995 | [JP] | Japan | 7-227104 |
| Dec. 1, 1995 | [JP] | Japan | 7-338072 |
| Apr. 26, 1996 | [JP] | Japan | 8-130715 |

[51] Int. Cl.[6] ..... A42B 3/06

[52] U.S. Cl. ..... 2/411; 2/171.3

[58] Field of Search ..... 2/410, 411, 412, 2/424, 425, 171.3, 184.5, DIG. 5, 6.1, 6.2, 6.3, 6.4, 6.5

[56] References Cited

U.S. PATENT DOCUMENTS

| | | | |
|---|---|---|---|
| 2,112,383 | 3/1938 | Sloan et al. | 2/171.4 |
| 2,144,870 | 1/1939 | Bullard | 2/410 |
| 3,496,854 | 2/1970 | Feldmann et al. | 2/410 |
| 4,700,411 | 10/1987 | Kawasaki et al. | 2/425 |
| 5,010,598 | 4/1991 | Flynn et al. | 2/411 |
| 5,345,614 | 9/1994 | Tanaka | 2/425 |

*Primary Examiner*—Michael A. Neas
*Attorney, Agent, or Firm*—Kanesaka & Takeuchi

[57] ABSTRACT

A protective cap is formed of a cap body having an inner layer and an outer layer with a clearance therebetween. A number of air holes are provided in the inner and outer layers so that the air holes in the inner layer are displaced from those in the outer layer, and a dam is provided around each of the air holes in the inner layer on a surface thereof facing the outer layer. A spacer formed of a vertical wall contacting the inner and outer layers is provided at least adjacent to each of the air holes of the inner layer. Thus, the protective cap has excellent ventilating capability, a waterproof feature in rain and strength.

12 Claims, 7 Drawing Sheets

PROTECTIVE CAP

FIELD OF THE INVENTION

The present invention relates to a structure of a protective cap worn for protection of a head in construction works, engineering works, and other works.

BACKGROUND TECHNOLOGY

At a site of various types of work, or in a plant, a worker wears a protective cap on the worker's head for protection against the danger caused by a flying or dropping object or against danger of injuries when the worker drops from a height. But if the protective cap is worn for a long time especially in summer or during work accompanied by hard physical labor, the worker's head is steamed by perspiration. As a result, the works become uncomfortable to the worker, and in addition the work efficiency becomes lower.

To provide a protective cap with permeability, there has been disclosed a protective cap made from a net or a meshed and porous material molded into a multi-layered structure with the lacked portions arranged alternately in Japanese Utility Model Laid-Open Publication No.143736/1985. Also the model described in Japanese Utility Model Laid-Open Publication No.7832/1983 has a feature to provide a protective cap with permeability, and further Japanese Utility Model Laid-Open Publication No.94430/1989 discloses an air ventilating device to be set inside safety and protective tools of a working helmet, a vehicle helmet, safety shoes or the like.

However, these protective caps do not have a waterproof feature in rainy weather when worn outdoors.

Japanese Utility Model Publication No.20108/1967 discloses a helmet having permeability and a waterproof feature in rainy weather, but in this model, small holes are provided in a side section of a cap body, so that a flying or dropping object may come inside the cap body through the holes and also the strength is not sufficient, and for the reasons the model can not achieve the essential object of a helmet to protect a wearer's head. Further, when a worker wearing the cap works in a slouching posture, rain water comes into the helmet, so that the helmet can not be worn in rainy weather.

DISCLOSURE OF THE INVENTION

It is an object of the present invention to provide a protective cap which is excellent in the permeability and ventilating capability, and having a waterproof feature in rainy weather or the like, and having a considerable strength.

The protective cap according to the present invention comprises a cap body having an inner layer and an outer layer with a clearance therebetween, a number of air holes are provided in the inner and outer layers so that the air holes in the inner layer are displaced from those in the outer layer, in addition dams are provided around the air holes on a surface of the inner layer facing the outer layer, and spacers each comprising a vertical wall contacting the inner and outer layers are provided adjacent to the air holes.

Also the protective cap according to the present invention comprises a cap body having an inner layer and an outer layer with a clearance therebetween, a number of air holes are provided in the inner and outer layers so that the air holes in the inner layer are displaced from those in the outer layer, and a spacer comprising a vertical wall having a plurality of air flow holes thereon and contacting the inner and outer layers is provided around each of the air holes in said inner layer.

Also preferably a reinforcing ring is provided around each of the air holes in the outer layer.

The protective cap according to another aspect of the present invention comprises a cap body having an inner layer and an outer layer with a clearance therebetween, and concave strips and convex stripes each extending from the vertex in the radial direction are provided alternately on a surface of the inner layer facing the outer layer with air holes provided in the convex strips, and on the other hand air holes are formed in the outer layer at positions opposite to the concave strips on the inner layer. Preferably, the convex strips on the inner layer contact the outer layer partially.

Also the protective cap according to still another aspect of the present invention has a convex strip having air holes at a vertex of a cap body, and comprises a cover having air holes and drain holes covering the convex strip with a space so that air holes of the convex strip and those of the cover will not be overlaid on each other. Preferably concave strips are formed along the convex strip.

BEST MODE FOR CARRYING OUT THE INVENTION

Next description is made for the best mode of the protective cap according to the present invention.

Figure 1:
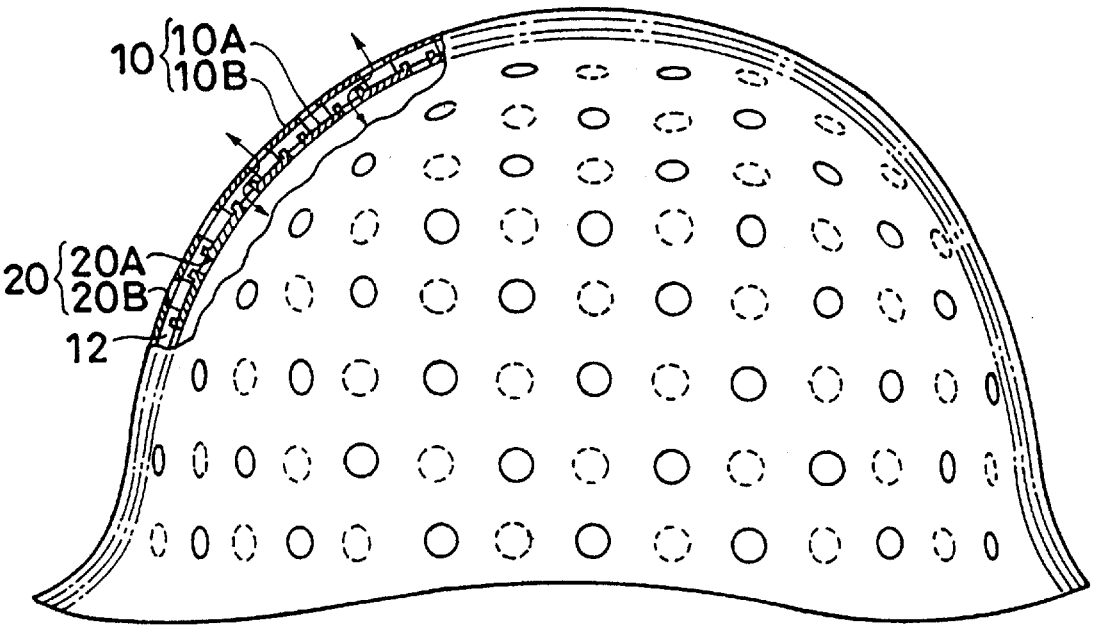
FIG. 1 is a side view showing a protective cap with a portion of the cap body lacked.

FIG. 1 is a side view showing a protective cap with a portion of the cap body lacked. A cap body 10 constituting a main body of the protective cap comprises two layers; an inner layer 10A and an outer layer 10B, and a clearance 12 is provided between the two layers. As a material for the protective cap 10, synthetic resin such as polyester, polypropylene, polyethylene, polycarbonate, and ABS resin may be used. When the strength is important, such a material as iron, steel, aluminium, aluminium alloy, and other high strength alloy may be used, and further such a material as fiber-reinforced plastics, or ceramics may be used, if a purpose of use of the protective cap requires In this embodiment, a thickness of the clearance 12 is substantially uniform in all the portions of the cap body 10 As described later, in the present invention, the clearance 12 mainly functions as a flow path for air, so that it is required to insure a space through which air can flow. For this reason, the of the clearance 12 is in a range from 1 to 20 mm, and more preferably in a range from 3 to 10 mm.

A number of air holes 20A, 20B are provided in the inner layer 10A as well as in the outer layer 10B. The air holes 20A, 20B are formed almost uniformly in the entire inner layers 10A and entire outer layer 10B, and in addition the air holes 20A and air holes 20B are displaced from each others In the present invention, the air holes 20A and 20B are arranged so that they are not overlaid on each other to prevent a flying or dropping object, rain water or the like from entering, via the air holes 20A, clearance 12, and air holes 20B from outside of the cap body 10 into inside of the cap body 10.

In this embodiment, inside of the inner layer 10A and outside of the outer layer 10B are communicated through the air holes 20A, clearance 12, and air holes 20B, so that external air flows between inside and outside of the cap body 10 as shown in arrow marks in FIG. 1.

The air holes 20A, 20B have a function as described above, so that they may be provided over the entire cap body 10, or may be provided in portions of the cap body 10, especially in the upper portion thereof, as described later.

Also the air holes 20A, 20B may be arranged either regularly or irregularly There is no specific restriction on a size of the air holes 20A, 20B, and any size is allowable on the condition that strength of the cap body 10 can be maintained. On the other hand, the larger the diameter of the air holes 20A, 20B, the lighter the cap body 10 is.

A form of the air holes 20A, 20B is not limited to a round form as shown in the figure, and also an oval form or a rectangular form is allowable. A size and a form of each of the air holes 20A may be different from those of each of the air holes 20B. Further, the inner layer 10A and/or outer layer 10B of the cap body 10 may be constructed on a meshed structure. However, it is important to arrange the air holes 20A and air holes 20B so that they are not overlaid on each other.

A dam 16 is provided in a circular form around the air hole 20A on a side of the inner layer 10A facing the outer layer 10B.

Figure 2:
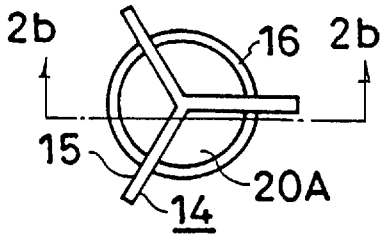
FIG. 2(*a*) is an enlarged view around an air hole provided in an inner layer of the protective cap, and FIG. 2(*b*) is a sectional view taken along line 2*b*—2*b* in FIG. 2(*a*)
Figure 2:
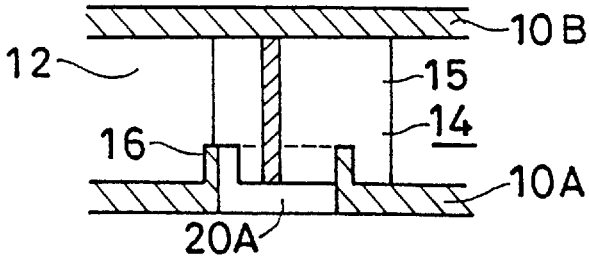

FIGS. 2(*a*) and 2(*b*) are enlarged views showing a section around the air hole 20A in the inner layer 10A, and FIG. 2(*a*) is a flat view showing a state when the outer layer 10B is removed, while FIG. 2(*b*) is a side view showing a longitudinal cross-section thereof taken along line 2*b*—2*b* in FIG. 2(*a*).

A required height of the dam 16 is if it is enough for preventing intrusion of rain water, so that the height is in a range from around 0.1 to 20 mm, and preferably in a range from around 1 to 3 mm.

In this embodiment, the dam 16 is erected upward in the vertical direction from a periphery of the air hole 20A, but a form of the dam 16 is not limited to that described above, and for instance, an upper edge section of the vertically erected section may be further bent outward, or the dam 16 itself may be inclined outward or inward against the air hole 20A to prevent intrusion of rain water into the air hole 20A.

Figure 3A:
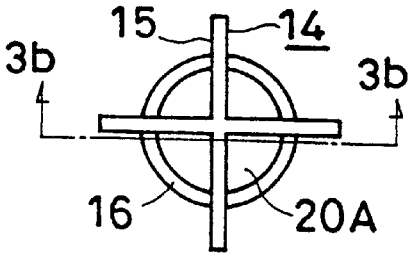
FIG. 3(*a*) is an embodiment of the protective cap according to the present invention in which a form of a spacer is changed, and FIG. 3(*b*) is a sectional view taken along line 3*b*—3*b* is FIG. 3(*a*)
Figure 3B:
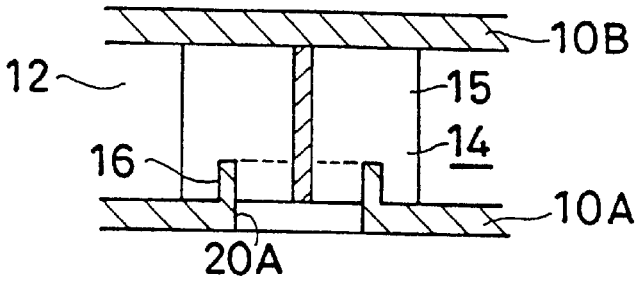

Provided at a center of the air hole 20A is a spacer 14 comprising a vertical wall 15 contacting the two layers of the inner layer 10A and outer layer 10B. The vertical wall 15 may be provided in a Y form across the dam 16, or may be provided in a cross form across the dam 16 as shown in FIG. 3(*a*). Also, the dam 16 may be arranged outside of the air hole 20 adjacent thereto.

In any of the embodiments described above, the spacer 14 plays a role for combining the inner layer 10A and outer layer 10B into a unit, and also for insuring a flow path for air by keeping the clearance 12 in the appropriate state. For this reason, it is necessary not to clog the air hole 20A by the spacer 14, and especially in the embodiment shown in FIG. 4(*a*), the vertical walls folded into two portions are provided at positions opposite to each other to insure a flow path 22 for air therebetween. Also the spacer 14 has a role for delivering an impact loaded to the outer layer 10B to the inner layer 10A for dispersion of the impact.

Figure 5A:
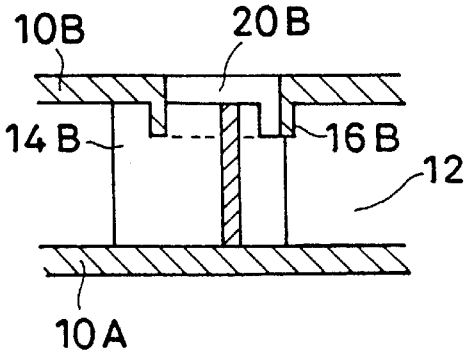
FIGS. 5(*a*) and 5(*b*) are enlarged views showing sections around an air hole provided in an outer layer of the protective cap.
Figure 5B:
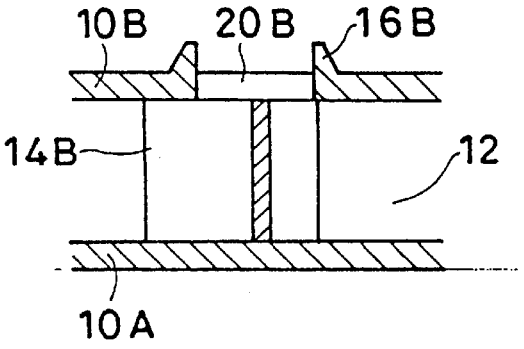

Accordingly, as shown in the sectional views shown in FIG. 5(*a*) and FIG. 5(*b*), the clearance 12 may be kept in the appropriate state with the cap body 10 further strengthened by providing spacers 14B also for the air holes 20B in the outer layer 10B like for the air holes 20A.

The spacer 14B provided for the air hole 20B may be one comprising the vertical wall 15 contacting both the inner layer 10A and outer layer 10B arranged in a Y form or a cross form, and one or more vertical walls 15 may be provided adjacent to the air hole 20B. The spacer 14B also has a role to prevent intrusion of a small flying object through the air hole 20B.

In FIG. 5(*a*) and FIG. 5(*b*), a reinforcing ring 16B is provided in a circular form around the air hole 20B. In FIG. 5(*a*), the reinforcing ring 16B having a vertical wall is formed to face the inner layer 10A, so that no projection is formed on a surface of the cap body 10. On the other hand, in FIG. 5(*b*), the reinforcing ring 16B is formed on an external surface of the outer layer 10B, and not only reinforces the air hole 20B, but also functions as a dam against rain drops. In FIG. 5(*b*), the reinforcing ring 16B has an inclined wall surface.

When the protective cap according to the present invention is used outdoors in rainy weather or the like, rain water comes into the clearance 12 of the protective cap through the air holes 20B in the outer layer 10B, collides with an external surface of the inner layer 10A, and then flows down along this external surface. Because of this feature, rain drops are always blocked by the dams 16 and never come into inside of the air holes 20A.

Figure 6A:
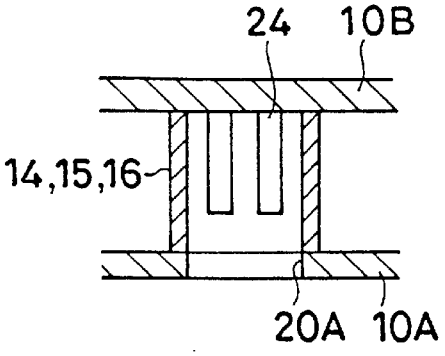
FIGS. 6(*a*) and 6(*b*) are side views showing a vertical cross-section of variants of the dam and the spacer.
Figure 6B:
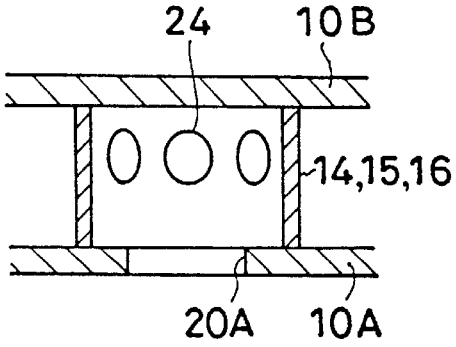

FIGS. 6(*a*) and 6(*b*) are vertical cross-sectional views showing variants of the dam 16 and spacer 14. In this embodiment, the dam 16 and spacer 14 are formed monolithically, and a plurality of air flow holes 24 is provided on a wall surface of the vertical wall 15 constituting the spacer 14.

The air flow holes 24 are provided in an upper section of a wall surface of the vertical wall 15 so that rain water will never come into the insides A form of the air hole 24 may be a slit form as shown in FIG. 6(*a*), or a round form as shown in FIG. 6(*b*).

To form the cap body 10 according to the present invention, the outer layer 10B with the air holes 20B already provided therein is placed over the inner layer 10A with the air holes 20A already provided therein, and the two layers are jointed and integrated with the spacer 14 described above.

Figure 7:
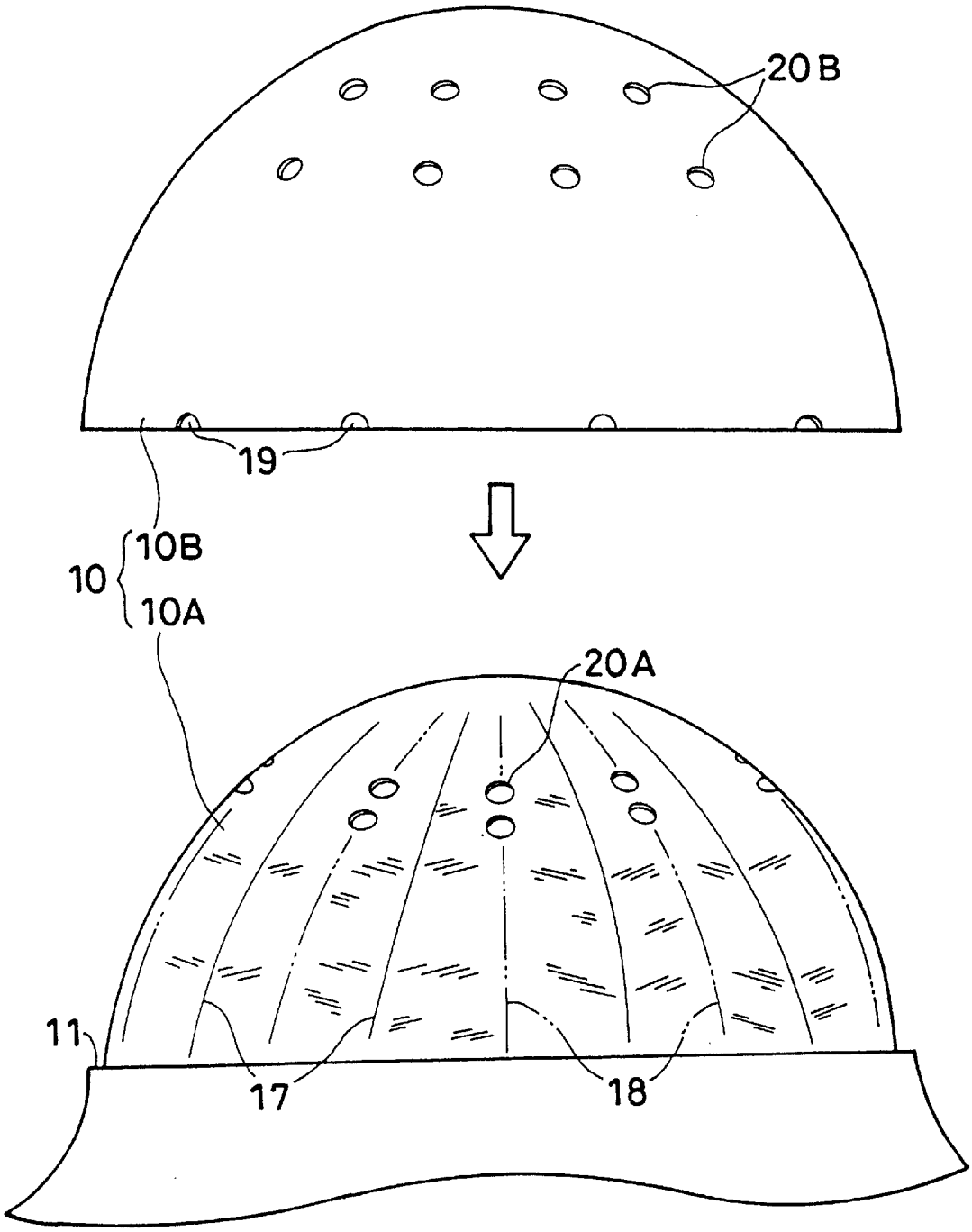
FIG. 7 is a side view showing an inner layer and an outer layer each constituting a cap body in the state where the inner and outer layers are separated in the vertical direction.

Next description is made for a different embodiment of the protective cap according to the present invention with reference to FIG. 7.

FIG. 7 is a side view showing the inner layer 10A and outer layer 10B for constituting the cap body 10 in the state where the two layers are separated from each other in the vertical direction, and a main body of the protective cap comprises the cap body 10. It should be noted that this view does not show a chip strap for prevention of dropping generally used for a protective cap, nor a so-called fit pad or an impact absorbing liner set inside the cap body 10 for buffering an impact loaded to the cap body 10.

A step section 11 is formed in a lower part of the inner layer in the peripheral direction, and when the outer layer 10B is set over the inner layer 10A, a lower edge rim of the outer layer 10B is engaged with this step section 11.

On a surface of the inner layer 10A positioned upward from the step section 11, concave strips 17 and convex strips 18 each extending in the radial direction from the vertex are alternately formed. The concave strips 17 play as flow paths for rain water as described above, and are required only to be relatively concaved against the convex strips 18, and for instance, strips each having a U-shaped or V-shaped cross-section or even a flat plain is allowable. A number of concave strips 17 and convex strips 18 is preferably in a range from 10 to 20.

Figure 4A:
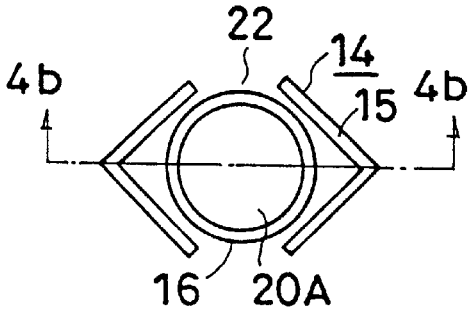
FIG. 4(*a*) is an embodiment of the protective cap according to the present invention in which a form and arrangement of each spacer are changed, and FIG. 4(*b*) is a sectional view taken along line 4*b*—4*b* is FIG. 4(*a*)
Figure 4B:
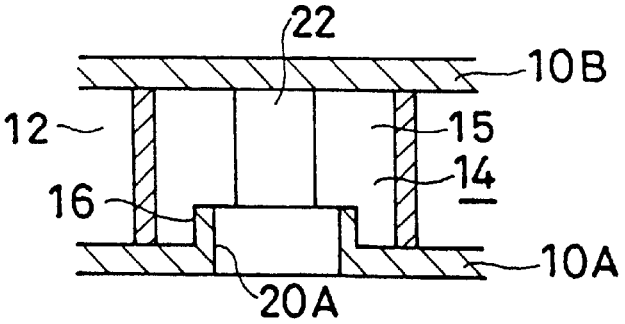

A plurality of air holes 20A are provided at appropriate positions on the convex strips 18. The air holes 20A are for flowing air therethrough, and there is not specific restriction over the positions where the air holes 20A are provided. A number of the air holes 20A is preferably in a range from several to several tens in all on the entire inner layer 10A. It should be noted that the dam 16 may be provided in a circular form around the air hole 20A so that it faces the outer layer 10B as shown in FIGS. 2 to 4 as well as in FIG. 6 to prevent intrusion of rain water, and also that the reinforcing ring 16B may be provided around the air hole 20B as shown in FIG. 5.

It is required that a size of the outer layer 10B is slightly larger than that of the inner layer 10A. Also a plurality of air holes 20B is provided in the outer layer 10B. The air holes 20B are provided so that the air holes 20B are not overlaid on the air holes 20A when the outer layer 10B is overlaid over the inner layer 10A. For this purpose, it is required to provide the air holes 20B at positions opposite to the concave strips 17 on the inner layer 10A. The same conditions for the air holes 20A are required for a size, a number of pieces, and a form of the air holes 20B.

The reference numeral 19 indicates water drain holes provided at several positions in a circular lower edge section of the outer layer 10B, and the drain holes 19 have a role for discharging rain water flowing down in the concave strips 17 on the inner layer to outside of the outer layer 10B.

Figure 8:
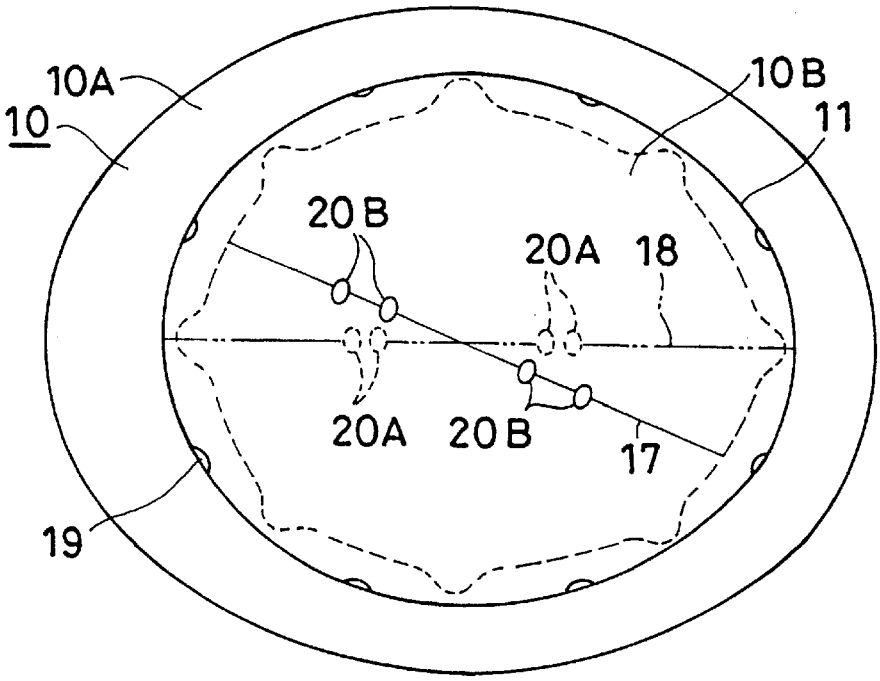
FIG. 8 is a flat view showing a cap body formed by setting an outer layer over the inner layer shown in FIG. 7.
Figure 9:
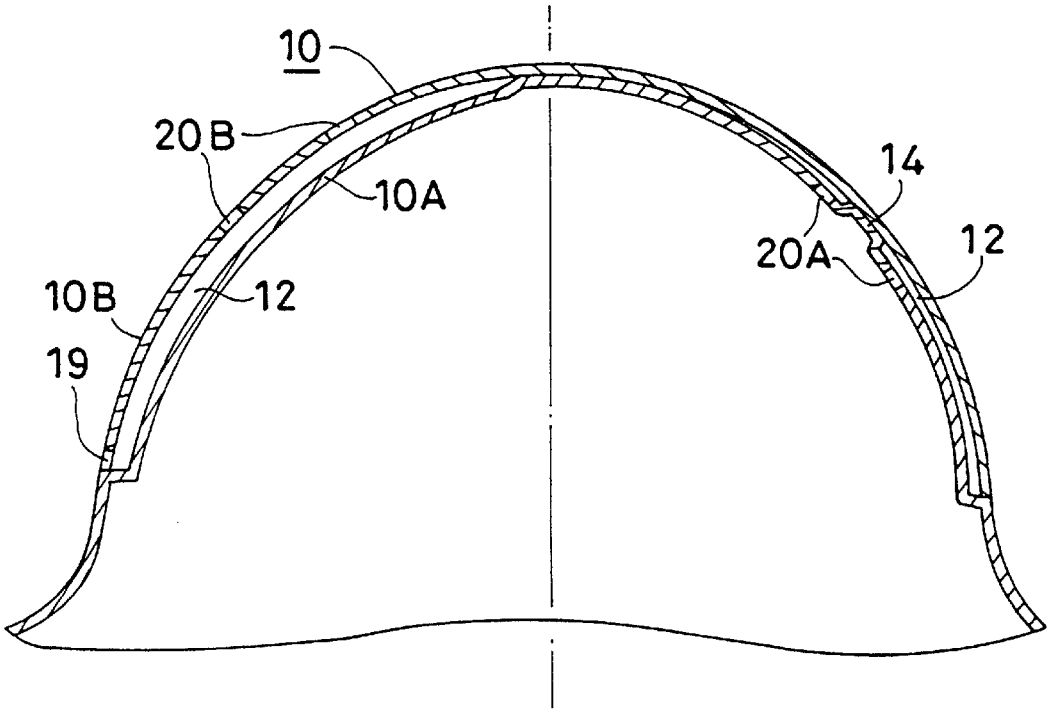
FIG. 9 is a vertical cross-section of the cap body shown in FIG. 8.

FIG. 8 is a flat view showing the cap body 10 formed by placing the outer layer 10B over the inner layer 10A shown in FIG. 7, and in this figure two solid lines each indicating arrangement of the air hole 20B in the outer layer and two dotted lines each indicating arrangement of the air hole 20A in the inner layer 10A are shown to indicate that the air holes 20A and air holes 20B are displaced from each others FIG. 9 is a side view showing a longitudinal cross-section of the cap body 10 shown in FIG. 8, and in the figure, a left half section was cut at a position of the concave strip 17 on the inner layer 10A, while a right half section was cut at a position of the convex strip 18 on the inner layer 10A. The clearance 12 is formed between the two layers 10A, 10B. Preferably, the thickness of the clearance 12 at the position of concave strip 17 is in a range from around 3 to 30 mm, and that at the position of convex strip 18 is in a range from around 1 to 20 mm.

For the purpose to promote integration of the inner layer 10A and outer layer 10B, or to increase strength of the protective cap 10, the spacers 14, 14B described above may be provided in the clearance 12. Also as shown in the right half section of FIG. 9, the convex strips 18 on the inner layer 10A may be contacted partially to the outer layer 10B so that the strips 18 play a role as the spacer 14.

When a protective cap according to the present invention is used outdoors in rainy weather, rain water comes into the clearance 12 of the protective cap through the air holes 20B in the outer layer 10B, and reaches an external surface of the inner layer 10A. Then, the rain water flows down along the concave strips 17 on the inner layer 10A, and is discharged to the outside through the drain holes 19 in the outer layer. Generally a protective cap put on worker's head frequently inclines, but as the air holes 20A provided in the inner layer 10A are positioned on the convex strips 18, the rain water does not flow inside of the inner layer 10A from the air holes 20A.

In a case of a protective cap which receives a strong wind pressure on its front section such as a protective cap for a bicycle rider, the concave strips 17 are not always required to be formed in the radial form from a vertex of the inner layer 10A, and in that case the concave strips 17 are preferably formed into lines so that rain water is smoothly discharged from a front section to a rear section thereof.

Figure 10:
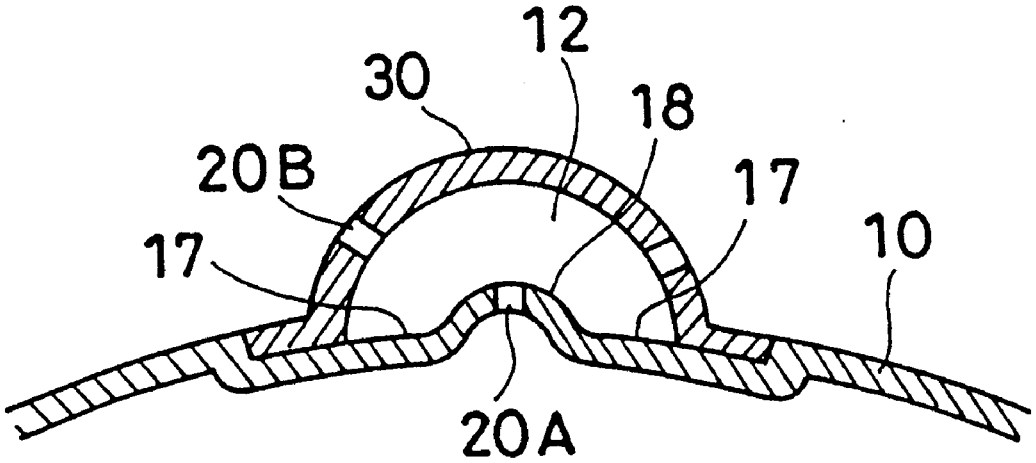
FIG. 10 is a side view showing a longitudinal cross-section of a key section in a different embodiment of the cap body according to the present invention.

Next description is made for a different embodiment of the protective cap of the present invention with reference to FIG. 10. The embodiment shown in FIG. 10 is different from the one described above in the point that only one convex strip 18 is formed at a vertex of the cap body 10. FIG. 10 is a cross-section of this convex strip 18 along a vertical surface crossing the convex strip 18 at right angles.

In this embodiment, the protective cap 10 is not divided to the inner layer 10A and outer layer 10B, and a cover 30 is engaged in the cap body 10 so that the cover 30 covers the convex strip 18 and the concave strips 17, 17 formed along the concave strips 18 at both sides thereof, and the cover 30 is integrated with the cap body 10 by means of ultra-sonic welding or the appropriate bonding method. A plurality of air holes 20B is formed in the cover 30 for the same purpose as that described in the previous embodiment, and the air holes 20B are provided at positions so that they are not overlaid on the air holes 20A provided in the convex strip 18.

With the configuration described above, the clearance 12 is formed between a section along the convex strip 18 of the cap body 10 and the cover 30, and also in this embodiment, like in the embodiment shown in FIG. 7 to FIG. 9, measures for permeability and those against rain water are taken. Especially, in the present embodiment, by providing the convex strip 18 in a direction from a front section to a rear section thereof at a vertex of the cap body 10, the air holes 20B can be oriented in a direction from right to left on the cap body 10, so that, even when the cap is used as a protective cap for a bicycle rider, a quantity of rain water coming into the clearance 12 can be minimized. A number of convex strips 18 is not always limited to one, and a plurality of convex strips 18 may be provided in parallel to each other in a direction from a front section to a rear section thereof on the cap body 10.

Figure 11:
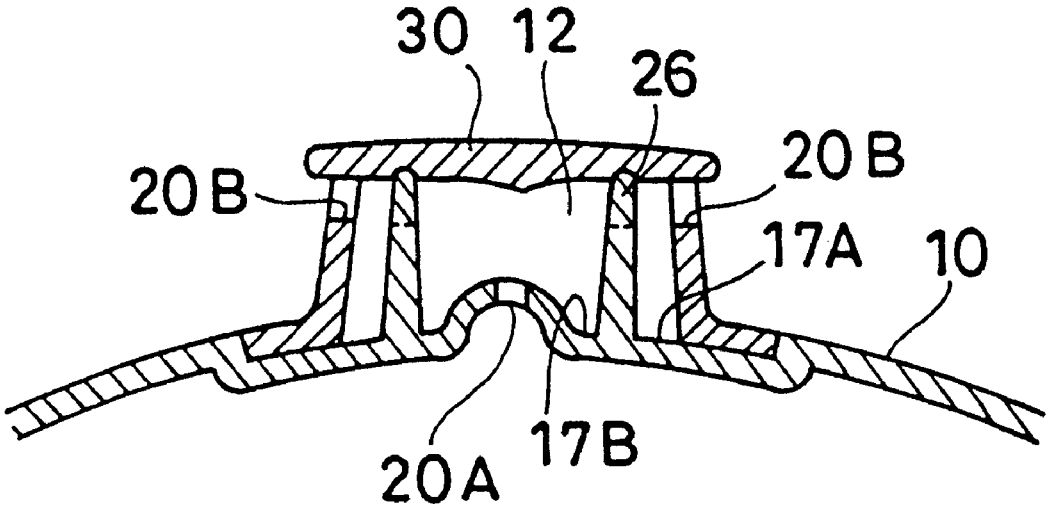
FIG. 11 is a side view showing a longitudinal cross-section of the cap body in a still different embodiment of the present invention.
Figure 12:
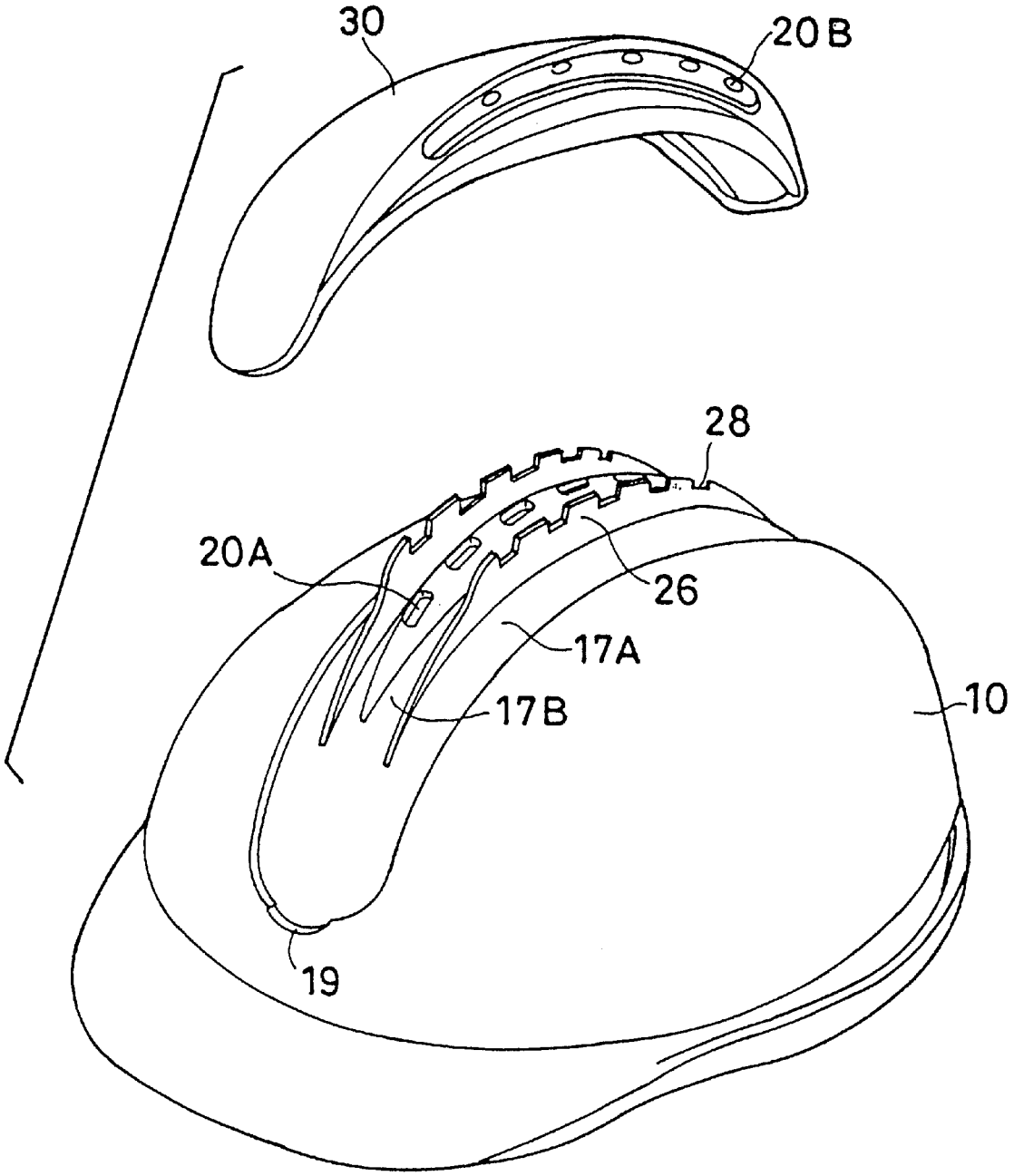
FIG. 12 is a perspective view showing the cap body 10 and cover 30 in the embodiment shown in FIG. 11 in the state where the cap body 10 and cover 30 are separated in the vertical direction.

Then description is made for a still different embodiment of the protective cap according to the present invention with reference to FIG. 11 and FIG. 12. FIG. 12 is a perspective view showing the cap body 10 and the cover 30 in the state where they are separated in the vertical direction, and FIG. 11 is a cross-section of a key section cut along a vertical surface crossing the convex strip 18 at right angles.

This embodiment is different from the embodiment shown in FIG. 10 in the point that a spacer 26 contacting an internal wall of the cover 30 and erecting from the concave strip 17 is provided in the clearance 12. The spacer 26 promotes integration of the cover 30 and cap body 10 to improve strength of the cap body 10, and if the spacer 26 is provided so that it surrounds the air hole 20A, the spacer 20 can also play a function as a dam for preventing intrusion of rain water.

Thus the concave strip 17A and 17B are provided outside and inside the spacer 26 respectively, so that prevention of intrusion of rain water can be achieved more completely It should be noted that air holes 28 are provided in a upper wall surface of the spacer 26, as shown in FIG. 12, to flow air therethrough.

It should be noted that, in the present invention, a buffering material such as foaming polystyrene or various types of sponge may be provided in the clearance 12. However, the buffering material must has a form not interfering permeability, ventilation, and a waterproof capability of the protective cap, and also the same considerations must be taken when the buffering materialis are set in the clearance 12.

We conducted, according to the requirements by the Labor Minister (The official annoucement No.39 from Labor Ministry dated on Jun. 5, 1991), the penetration resistance test (Article 6 and Article 7) and shock absorbing test (Article 8) for all the types of the protective cap described above, and all the protective caps satisfied the required performance.

APPLICABILITY FOR INDUSTRIAL PURPOSES

The protective cap according to the present invention is excellent in the permeability and ventilating capability, and can completely prevent intrusion of rain water, Also, when a cap body is constructed on a dual structure, the cap body has especially high strength, is excellent in shock resistance, and has high safety as a protective cap.

For the reasons as described above, the protective cap according to the present invention can be used in various construction works, in operating a heavy construction machine, in driving a vehicle or an airplane, in guarding works inside or outside a building, in works by policemen or firemen, and further in playing American football, ice hockey, and other types of sports. Also the protective cap can be worn at a site of construction works for a building, a dam, or the like, at a site for construction of a road, tunnel, or the like, or at a work shop in a ship mill, an iron foundry, an ironworks, at a mining site, and at sites for various works or in plants.

I claim:

1. A protective cap comprising a cap body having an inner layer and an outer layer with a clearance therebetween, wherein a number of air holes are provided in the inner and outer layers so that the air holes in the inner layer are displaced from those in the outer layer, a dam is provided around each of the air holes in the inner layer on a surface thereof facing the outer layer, and a spacer comprising a vertical wall contacting the inner and outer layers is provided at least adjacent to each of said air holes of the inner layer.

2. The protective cap according to claim 1, wherein an additional spacer comprising a vertical wall contacting the inner and outer layers is provided at least adjacent to each of the air holes in said outer layer.

3. The protective cap according to claim 1, wherein a reinforcing ring is provided around each of the air holes in said outer layer.

4. A protective cap comprising a cap body having an inner layer and an outer layer with a clearance therebetween, wherein a number of air holes are provided in the inner and outer layers so that the air holes in the inner layer are displaced from those in the outer layer, a spacer comprising a vertical wall having a plurality of air flow holes therein and contacting the inner and outer layers is provided around each of the air holes in said inner layer.

5. The protective cap according to claim 4, wherein an additional spacer comprising a vertical wall contacting the inner and outer layers is provided at least adjacent to each of the air holes in said outer layer.

6. The protective cap according to claim 4, wherein a reinforcing ring is provided around each of the air holes in said outer layer.

7. A protective cap comprising a cap body having an inner layer and an outer layer with a clearance therebetween, wherein concave strips and convex strips each extending from a vertex of the inner layer in a radial direction are alternately provided on a surface of said inner layer facing said outer layer, air holes are provided in said convex strips, and also air holes are formed in said outer layer at positions opposite to the concave strips on said inner layer.

8. The protective cap according to claim 7, wherein a dam is provided around each of the air holes in said inner layers.

9. The protective cap according to claim 7, wherein a reinforcing ring is provided around each of the air holes in said outer layer.

10. The protective cap according to claim 7, wherein the convex strips on said inner layer contact the outer layer partially.

11. A protective cap in which a convex strip having air holes at a vertex of a cap body is formed, a clearance along said convex strip is formed by a cover having air holes and drain holes therein, and the air holes in said convex strip and the air holes in said cover are formed so that they are not overlaid on each other.

12. The protective cap according to claim 11, wherein concave strips are formed along said convex strip.

* * * * *